US005772132A

United States Patent [19]

Reid

[11] Patent Number: 5,772,132

[45] Date of Patent: Jun. 30, 1998

[54] SELF-PROPELLED ROCK CRUSHING MACHINE

[76] Inventor: Donald W. Reid, 2004 Crest Mar Ct., El Dorado Hills, Calif. 95762

[21] Appl. No.: 700,872

[22] Filed: Aug. 21, 1996

[51] Int. Cl.[6] ..... B02C 21/02

[52] U.S. Cl. ..... 241/60; 241/81; 241/101.74

[58] Field of Search ..... 241/81, 34, 101.74, 241/101.741, 101.742, 60

[56] References Cited

U.S. PATENT DOCUMENTS

| | | | |
|---|---|---|---|
| 2,117,300 | 5/1938 | Corser . | |
| 2,276,333 | 3/1942 | Ovestrud . | |
| 3,841,570 | 10/1974 | Quinn . | |
| 3,927,839 | 12/1975 | Quinn . | |
| 4,607,799 | 8/1986 | Currie . | |
| 5,161,744 | 11/1992 | Schoop et al. . | |
| 5,460,332 | 10/1995 | Frick . | |
| 5,476,227 | 12/1995 | Tamura et al. . | |
| 5,622,322 | 4/1997 | Tamura et al. | 241/101.74 |

*Primary Examiner*—Mark Rosenbaum
*Attorney, Agent, or Firm*—Richard C. Litman

[57] ABSTRACT

A self-propelled rock crushing machine prepared according to the present invention utilizes the drive unit to a conventional excavator of the type normally found in the construction industry. For simplified repairs or replacement of its components, each of the components on the self-propelled rock crushing machine are removably secured to its vehicular frame. The components include a hopper that stores material to be crushed, an apron feeder that collects material from the hopper and carries the material toward the crushing device, a grizzly separator that separates undersize material from the larger material to be crushed, a crushing device, and a discharge conveyor that receives crushed material and discharges the same from its outer end. A water tank and pump also are provided for preparing properly moisturized crushed material which is suited for backfill operations. Because the discharge conveyor is placed immediately below the vehicular frame, the rock crushing machine of the present invention has a ground clearance of approximately seventeen inches, which enables it to crush while moving over rugged construction terrain. Hydraulic motors are provided for operation of each of the components, and the water pump also is hydraulically operated. Each motor and the pump are connected to the hydraulic system of the drive unit, and controls are provided for operation of the same. The separate controls offer variable speed control for each component to provide versatile operation under various conditions.

13 Claims, 6 Drawing Sheets

SELF-PROPELLED ROCK CRUSHING MACHINE

BACKGROUND OF THE INVENTION

1. Field of the Invention

The present invention relates to construction equipment, and more particularly to a mobile rock crushing machine. Even more particularly, the present invention relates to a self-propelled vehicle capable of crushing rock and discharging the pulverized pieces of rock into a windrow as the vehicle moves. The present invention also relates to a self-propelled rock crushing machine assembled from the existing drive unit of a conventional excavator and commercially available components. Moreover, the present invention relates to a convertible rock crushing machine having its individual components releasably secured to the machine for easy exchange or repair of the individual components, or conversion of the machine back into an excavator.

2. Description of the Prior Art

In the construction industry, there have long been used various types of crushing apparatus which pulverize rocks, stones, cement, and bricks, etc. for the purpose of reducing rubble to more conveniently sized pieces of material. The same can be said for apparatus used at quarries where it is necessary to crush rock and ore into variously sized material, which may be sorted, sold, and used according to its size. In the construction industry, however, it is of particular concern that the rock crusher be mobile or otherwise capable of transport. For example, it may be necessary to relocate a rock crusher from one road construction site to another. To accommodate this need, the prior art contains numerous examples of mobile or transportable rock crushers.

U.S. Pat. No. 2,117,300, which issued to John Corser on May 17, 1938, discloses a rock crushing machine that separates finely crushed material (i.e., sand) for collection and recycles larger material for repeated crushing. The Corser apparatus utilizes a pair of crushing elements for differently sized material, whereby both crushing elements deliver the crushed material to a system of conveyors that returns the crushed material to the single separating device. Finely crushed material passes through the separator and is delivered to the output location, whereas larger material is continuously recycled until it is finely crushed.

U.S. Pat. No. 2,276,333, which issued to Melvin Ovestrud on Mar. 17, 1942, discloses an apparatus and method for crushing and segregating materials. The apparatus disclosed in the Ovestrud patent is disposed particularly for the production of fine rock material having a size of approximately between one-quarter and one-half inch in diameter. The Ovestrud apparatus uses a plurality of crushing elements, fed by various conveyer systems, that operate in succession to reduce the size of rock and separate the same according to its size.

U.S. Pat. Nos. 3,841,570 and 3,927,839, which issued to John N. Quinn on Oct. 15, 1974, and Dec. 23, 1975, respectively, disclose a rock crushing plant and a crushing apparatus. Each discloses a rock crushing apparatus that contains a pre-crushing separating unit that separates rock according to its size. Material of the final product size and sand are removed from the apparatus, whereas larger rocks of different sizes are segregated and separately transported over various conveyor systems. A primary crusher is used following the initial segregation to reduce larger rocks, and material is further segregated before entering the secondary crusher. At the secondary crusher, material output of finished size is discharged by conveyor and material which remains too large is recycled for repeated passage through the secondary crusher.

Each of the above-listed patents discloses a rock crushing apparatus that is transportable by sets of wheels located thereon. The apparatus, however, are not capable of self-powered transportation. Instead, they require another vehicle to tow them to the construction site, where they remain stationary during use. Furthermore, each of the above-listed apparatus utilizes repeated crushing cycles to reduce rock size to within the range of finely crushed material or sand. Thus, an elaborate conveyor system is necessary to ensure proper crushing of the rock.

Because modern construction sites may be extremely large, such as highway construction sites, it is preferable to have a rock crusher that is not only transportable between sites, but also mobile at the construction site. Having a rock crusher that is mobile at the construction site saves time and obviates the need for numerous trucks to haul material to and from the rock crusher. By providing a rock crusher that is mobile at the construction site, crushed material may be produced where it will later be needed. Thus, it is extremely advantageous to provide a rock crusher of the type that is mobile at the construction site.

An alternative form of rock crusher is the type disclosed in U.S. Pat. No. 4,607,799, which issued to Bobby R. Currie on Aug. 26, 1986. The mobile stone crusher disclosed in Currie is disposed for use in connection with a track loader, which moves the stone crusher along the ground to crush rocks and other debris located in its path. However, use of this device at a construction site necessarily requires prior alignment of material to be crushed, which generally is accomplished with the use of a road grader. Moreover, because the crusher is carried over the ground, the mobile stone crusher is not well adapted for use over rough terrain.

A transportable crusher unit is disclosed in U.S. Pat. No. 5,161,744, which issued to Gunther-Dietmar Schoop on Nov. 10, 1992. The transportable crusher unit comprises a frame that supports a crusher unit, separable crawler elements removably attached to the frame, and a plurality of lift jacks integral with the frame. When the crusher unit is to be moved, the lift jacks are raised to elevate the frame, and the crawler elements are separated from the frame so that a flatbed trailer may be driven beneath the frame. In this way the crusher unit may be transported without the need for special vehicles. While the crusher unit is at a site, the crawler elements provide necessary traction to allow for some mobility over the uneven terrain. Because the Schoop et al. apparatus utilizes two separate and distinct sets of crawler elements to drive the device and the frame is relatively low in the region between the two sets of crawler elements, the crusher unit is not readily adapted for a significant amount of travel at the construction site. Instead the crusher unit may be maneuvered into position using the driven crawler elements, and then the crusher unit may rest in place during operation. A second embodiment of the Schoop et al. crusher unit is placed onto support trestles where it remains in a fixed location during operation.

U.S. Pat. No. 5,460,332, which issued to Dietmar Frick on Oct. 24, 1995, discloses a mobile crusher apparatus capable of self-propelled movement on crawler elements. The crusher comprises a hopper for receiving rock or debris, and a crusher having a discharge conveyor. The hopper and discharge conveyor are pivotally mounted for hydraulic reciprocation relative to the crusher, so that the hopper and discharge conveyor sections may be hydraulically lowered to place sets of wheels thereon onto the ground. This action elevates the crawler elements upwardly from the ground. A tractor may hitch to the lowered hopper section to haul the rock crusher on the highway. While the system for converting the Frick crusher into a transportable crusher is described in detail, operation of the crusher is not adequately described. It is not apparent from the description whether the crusher is of the type that is disposed for crushing material while moving over the uneven terrain at a construction site to provide a continuous crushing operation.

U.S. Pat. No. 5,476,227, which issued to Yukio Tamura et al. on Dec. 19, 1995, discloses a self propelled crushing machine. The crushing machine has a pair of crawler elements for transportation, and a hopper and crusher strategically located relative to the engine to avoid an excessive height of the crushing machine. Specifically, the engine is located at one end of the chassis, with the hopper located at the other end, and the crusher located intermediate the engine and hopper. A discharge conveyor collects crushed material from the outlet of the crusher, located generally at the middle of the machine, and carries it forwardly from the machine.

Because the greatest concern with the Tamura et al. crushing machine is its overall height, the placement of the discharge conveyor beneath the platform supporting the crusher requires the conveyor to lie between the crawler mechanism. This severely limits the height clearance for the underside of the machinery. Construction sites typically have rough terrain that necessarily requires heavy-duty drive mechanisms and high ground clearance. While the Tamura et al. apparatus may travel at a construction site, it is particularly designed for simplified transportation between construction sites. By limiting the ground clearance of the machine, it is not particularly suited for movement during the crushing process. This is evident from a Komatsu advertising brochure for the BR300J Mobile Crusher, where the discharge conveyor is shown in a position that is substantially lower than the claimed ground clearance. It is also evident from the fact that the machine disclosed in the patent does not provide the operator with a protected operating station (i.e., cage), which normally is mandated for vehicles that move while performing operations.

Modern construction codes generally mandate specifications for the size of material used in backfill operations such as, for example, "six-minus" for backfill matter that is six inches or smaller, or "three-minus" for backfill material that is three inches or smaller. There is a need in the industry for a machine that can produce finish backfill that meets specifications for particulate size and also has a sufficient moisture content to minimize sinking. Modern construction codes also typically limit the amount and content of material which may be buried. Large rocks, which typically cannot be buried, usually result in an overburden with large material and a contrasting need for sufficient undersize material. When there is a need for undersize material and a burden of oversize material, such materials historically have been hauled to or away from the construction site, respectively. Thus, a rock crushing machine that can produce finish backfill at the precise location where it is needed would save a considerable amount of time and money in conducting operations at construction sites.

None of the above prior art discloses a rock crushing machine that specifically is designed and disposed for crushing rock and other debris while the machine is moving, and discharging the crushed material into a windrow for later use. Furthermore, none of the prior art discloses a rock crushing machine capable of producing finish backfill material that has a sufficient moisture content. The prior art provides rock crushing apparatus that are both transportable over the highway and to some extent mobile at a construction site. However, there is a need for a rock crushing machine that may provide crushed material into a continuous windrow as the crushing machine propels itself over the construction terrain.

Furthermore, none of the above prior art provides a rock crushing machine having detachable components. While the crawler elements in the Schoop et al. patent disclosed above were detachable, none of the major components of the crushing machine (i.e., the hopper, the feed conveyors, the crushing devices, and discharge conveyors, etc.) were detachable for replacement or removal from the device. Finally, none of the above noted prior art specifically discusses variable speed control for the drive mechanisms which operate the different components of the rock crushing machines.

None of the above inventions and patents, taken either singly or in combination, is seen to describe the instant invention as claimed.

SUMMARY OF THE INVENTION

A self-propelled rock crushing machine prepared according to the present invention utilizes the drive unit to a conventional excavator of the type normally found in the construction industry. A hopper is provided for storing material to be crushed, and an apron feeder collects material from the hopper and carries the material toward the crushing device. Material falls from the apron feeder into a grizzly separator that has a grate for separating undersize material from the larger material to be crushed. The undersize material falls into a by-pass chute, while the larger materials fall into the crushing device for pulverizing. A discharge conveyor provided beneath the crushing device and the by-pass chute collects crushed material and discharges the material from its outer end. Because the discharge conveyor is placed immediately below the drive unit, the rock crushing machine of the present invention has a ground clearance of approximately seventeen (17") inches. This enables the rock crushing machine of the present invention to crush while moving over rough construction terrain.

Hydraulic motors are provided for operation of the apron feeder, the grizzly separator, the crushing device, and the discharge conveyor. Each motor is hydraulically connected to the hydraulic system of the drive unit, and individual controls are provided for operation of each motor and, hence, each component. The separate controls offer variable speed control to provide versatile operation of the crushing machine under various conditions.

To facilitate the production of a pre-saturated or moisturized backfill material, a water tank and hydraulic pump are connected to the drive unit and a plurality of spray nozzles are provided at the end of the discharge conveyor. Depending upon the necessary moisture content, the pump may be regulated using the hydraulic controls. Furthermore, because the rock crushing machine may crush and move at the same time, the rock crushing machine is particularly adapted to provide finish backfill where it is needed.

To facilitate simple assembly of the rock crushing machine, the components and several hydraulic motors are removably secured to the frame of the drive unit. Typical nut and bolt connections are used to stabilize each component on the frame, as well as provide simple means for removal of the component if the need arises. By providing removable components, the rock crushing machine of the present invention may easily be repaired using commonly available components.

Accordingly, it is a principal object of the invention to provide a self-propelled rock crushing machine capable of crushing rock or other debris while traveling through a construction site to provide a windrow of crushed material.

It is another object of the invention to provide a rock crushing machine all of whose crushing components are detachably connected to the drive unit for easy replacement of the component.

It is a further object of the invention to provide a rock crushing machine all of whose crushing components are detachably connected to the drive unit of a conventional excavator for conversion of the device from a rock crusher back to an excavator.

Still another object of the invention is to provide a rock crushing machine that has all of its movable components provided with variable speed control to regulate the flow of material into and out of the rock crushing machine.

It is an object of the invention to provide improved elements and arrangements thereof in an machine for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
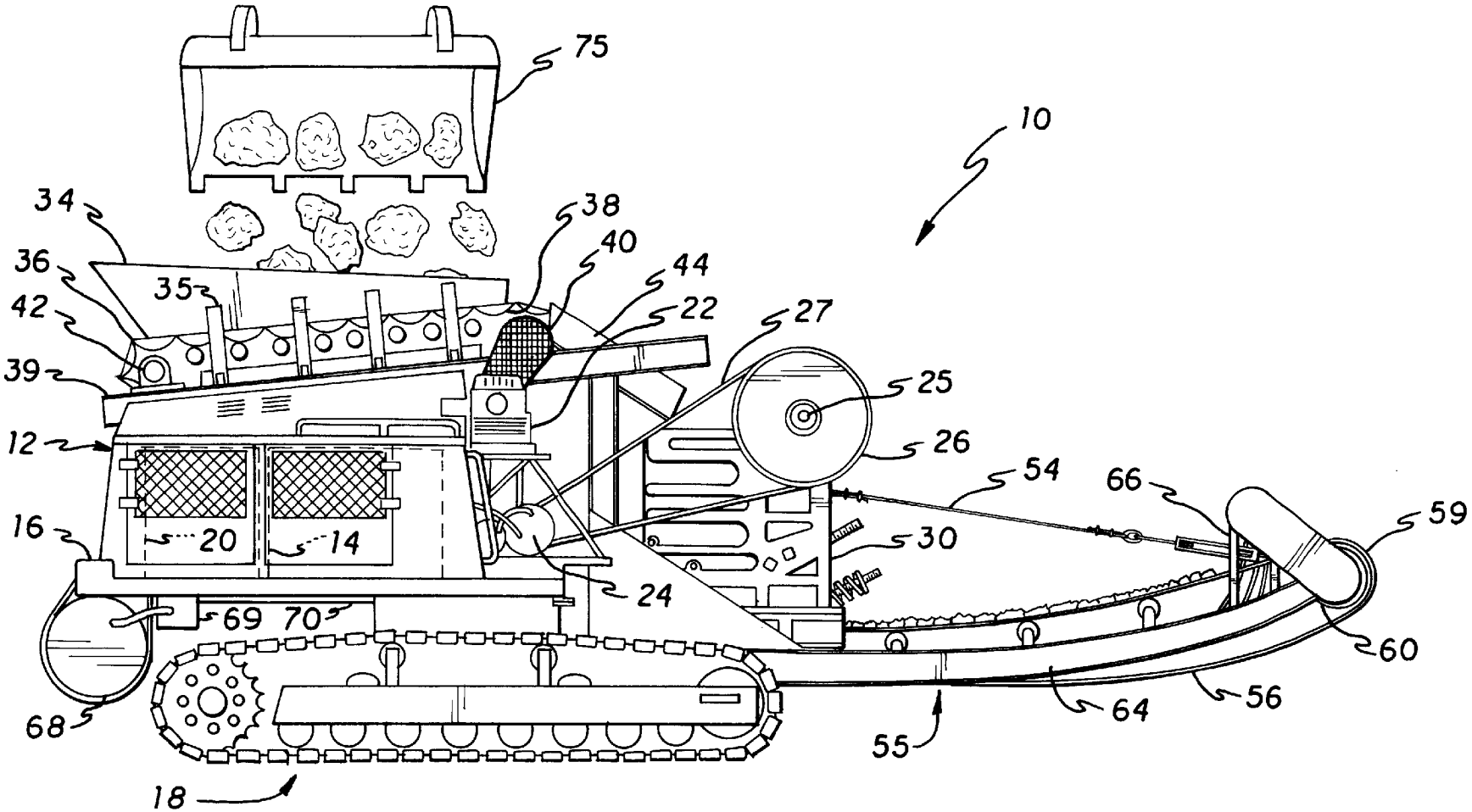
FIG. 1 is an side elevational view of the self-propelled rock crushing machine of the present invention, which shows the rock crushing machine receiving rock to be crushed and discharging crushed material.
Figure 1A:
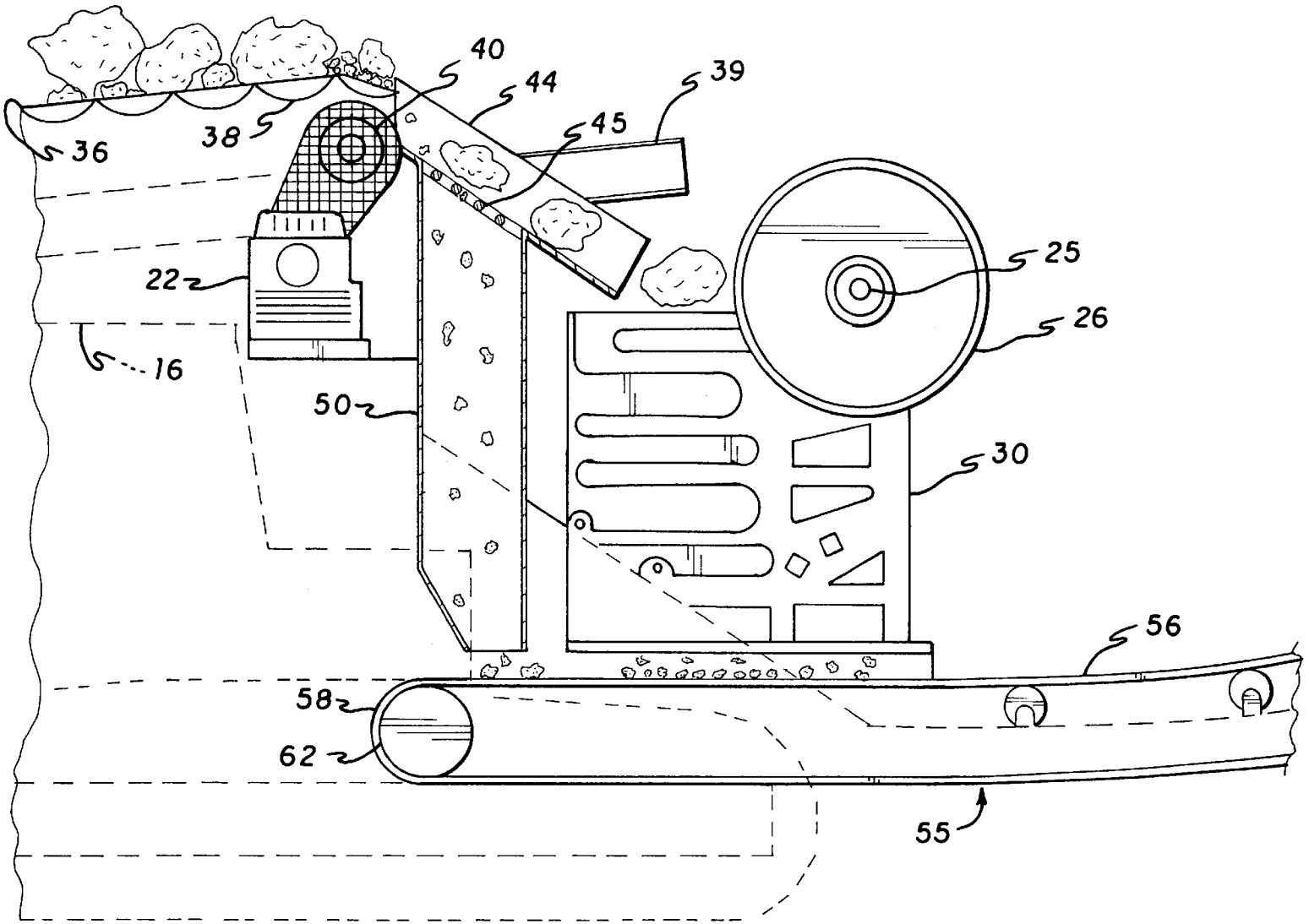
FIG. 1A is an enlarged side elevational view of the rock crushing components, with a portion of the grizzly separator and by-pass chute broken away to expose the grate through which separation occurs.

Referring to the figures by numerals of reference, and first to FIGS. 1 and 1A, 10 denotes generally a self-propelled rock crushing machine of the present invention. The rock crushing machine 10 comprises a drive unit 12 of a conventional piece of industrial construction equipment such as an excavator. The drive unit 12, which previously has been stripped of its excavator components, comprises an engine 14 supported on a vehicular frame 16 that is coupled to a crawler type drive mechanism 18. The crawler type drive mechanism 18 is driven by the engine 14 for transportation of the rock crushing machine 10 at a construction site, including while performing crushing operations as discussed hereinafter. The rock crushing machine 10 is particularly suited for conducting crushing operations while moving because a clearance of at least seventeen inches (17") is provided between the ground and discharge conveyor 55. In addition, the engine 14 comprises generally a hydraulic fluid system 20 (with pump) for driving a plurality of hydraulic motors 21, 22, 23, 24.

Figure 2:
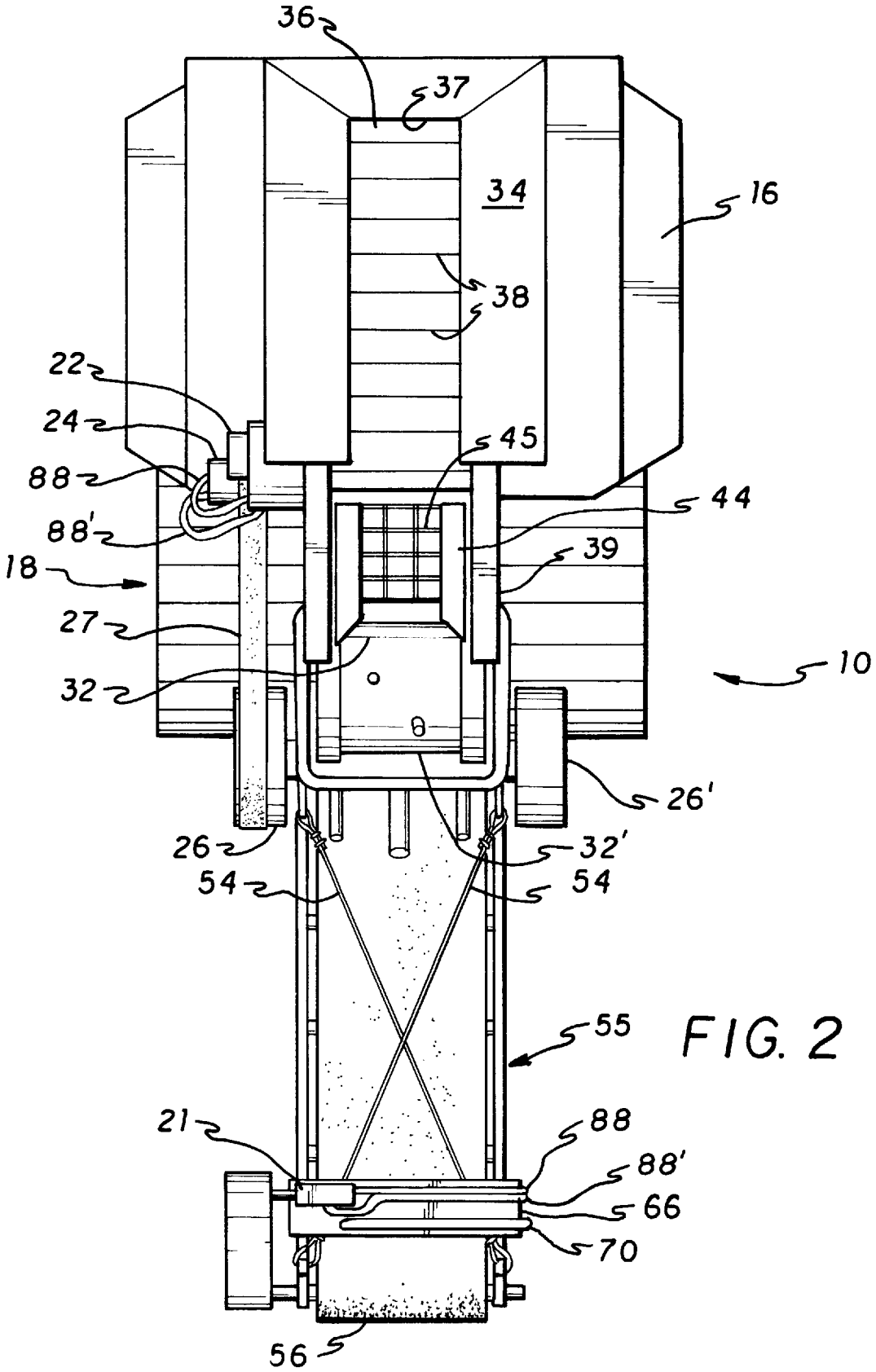
FIG. 2 is a top plan view of the present invention showing the relationship between the various rock crushing components.

With the engine 14 located at the rear of the vehicular frame 16, a conventional crusher 30 is mounted on the front end of the vehicular frame 16. Preferably the crusher 30 is provided with jaws 32, 32' (shown at FIG. 2) that are capable of crushing large materials and a high volume of material. Jaws 32, 32' having dimensions of approximately twenty-four inches by thirty-six inches (24"×36") generally will provide sufficient crushing capacity for the type of operations which the rock crushing machine 10 is disposed. It should be apparent, however, that any type of crusher (i.e., impact crusher or jaw crusher) capable of handling the desired material size and volume will suffice.

During operation of crusher 30, one jaw 32 is stationary while the other jaw 32' reciprocates toward and away from jaw 32 for crushing of materials passing therebetween. Jaw 32' is suspended upon a shaft 25 that connects through the crusher housing to a pair of hubs 26, 26'. The crusher 30 is driven by hydraulic motor 24, which originally functioned as the swing motor during use of the drive unit 12 for an excavator. To adapt the hydraulic motor 24 for operation of crusher 30, the motor 24 is coupled by a belt drive 27 to hub 26. Acting through hub 26, motor 24 imparts reciprocating movement to the jaw 32' (up to approximately 90 gpm) for repeated impact of the jaws 32, 32' against material passing through the crusher 30.

A hopper 34 and an apron feeder 36 are positioned above the drive unit 12 for, respectively, storing material to be crushed and moving the material towards the crusher 30. The apron feeder 36 is releasably secured to a frame 39, which also is releasably secured to the top of the drive unit 12 as discussed hereinafter. A plurality of integral, lateral hopper supports 35 are spaced along the length of frame 39 for providing support to the hopper 34. The hopper 34 has a plurality of angled walls that taper inwardly to define a bottom opening 37 which extends along the entire length of the hopper and exposes the apron feeder 36. Apron feeder 36 comprises a continuous linkage of plates 38 that are carried over a driving roller 40 and a driven roller 42. Motion is imparted to the linkage of plates 38 by the action of hydraulic motor 22. Hydraulic motor 22, which is releasably secured to the vehicular frame 16, is connected via a chain driven assembly to the driving roller 40. As hydraulic motor 22 drives roller 40, the plates 38 on apron feeder 36 carry the material toward crusher 30 from hopper 34. Apron feeder 36 is inclined to elevate the material as it approaches crusher 30.

Material that is carried to the end of apron feeder 36 falls first into a grizzly separator 44, which comprises a grate 45 having a plurality of generally uniform openings that allow undersize material to pass therethrough for separation from the larger material to be crushed. Preferably the grate 45 will allow undersize material of approximately three inches (3") in diameter or smaller to pass therethrough. This is an adequate size for conducting most backfill operations, one of the tasks for which the rock crushing machine 10 particularly is disposed. It should be apparent, however, that use of rock crushing machine 10 for a different purpose may require use of a grizzly separator 44 having a grate 45 with smaller or larger openings that allow passage of smaller or larger material, respectively.

Figure 3:
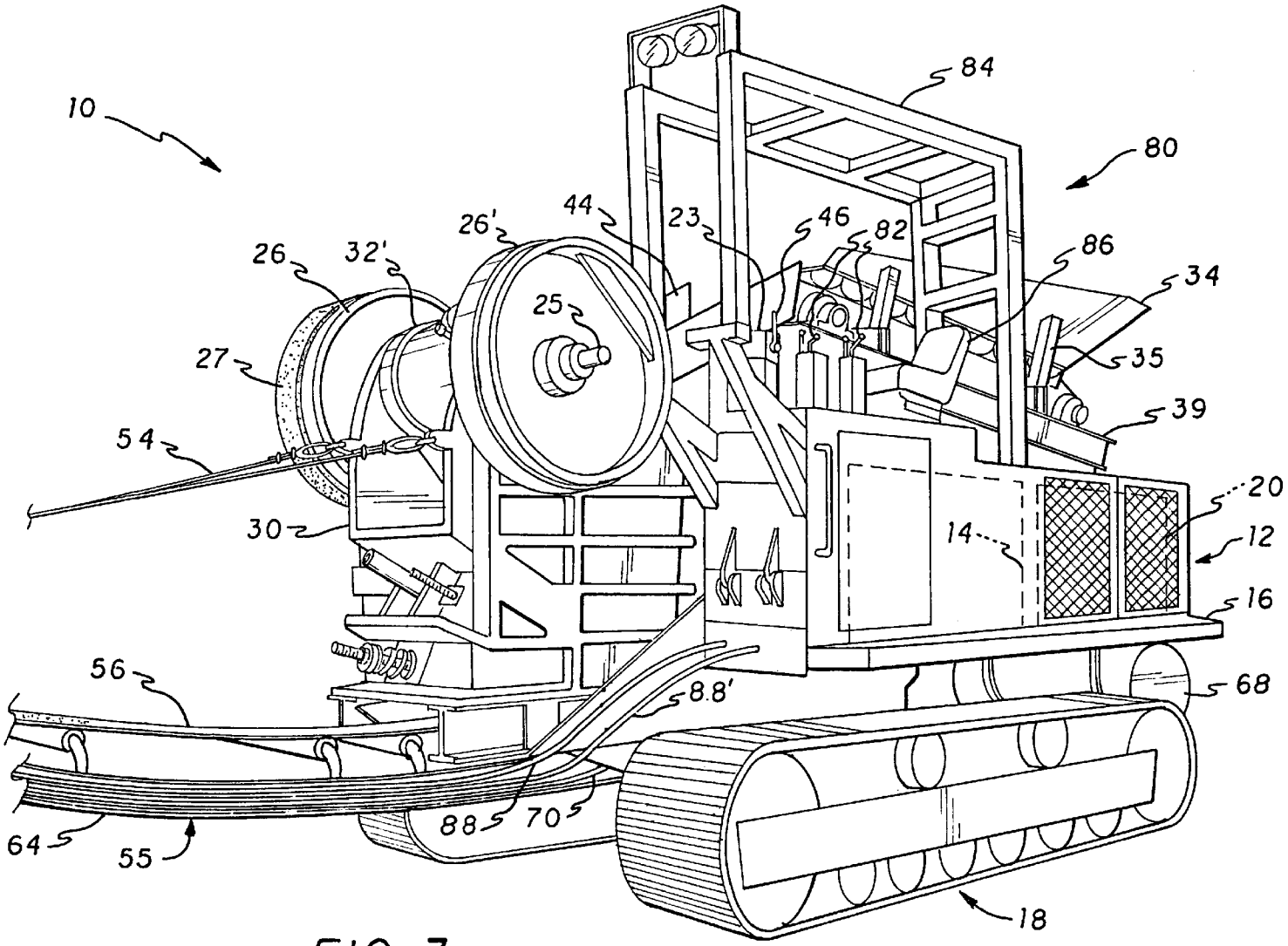
FIG. 3 is a perspective view of the rock crushing machine showing the discharge conveyor emerging from beneath the crusher, and the position of the operator's controls.

Grizzly separator 44 is releasably secured to the apron frame 39 as discussed hereinafter. The grizzly separator 44 is angularly positioned to receive all material from the apron feeder 36 and to carry the larger material to the crusher 30. A vibrator arm 46 has one end connected to the grizzly separator 44 and its other end connected to the hydraulic motor 23. Hydraulic motor 23, which is releasably secured to the vehicular frame 16 adjacent an operator's station 80 (as shown in FIG. 3), provides selective control to operate vibrator arm 46 independently of the use of grizzly separator 44. Where it is necessary to agitate grizzly separator 44, motor 23 may provide such agitation via vibrator arm 46, which causes small material to fall through grate 45 while larger material remains on top of the grate. Alternatively, motor 23 may attach directly to the grizzly separator 44 with a cam-type rotary vibrator contacting the grizzly separator to produce the necessary agitation. The angular position of grizzly separator 44 encourages larger material to move downwardly towards the receiving opening on crusher 30. The vibration imparted to grizzly separator 44 also prevents the larger materials from becoming lodged in the grate 45.

Figure 5:
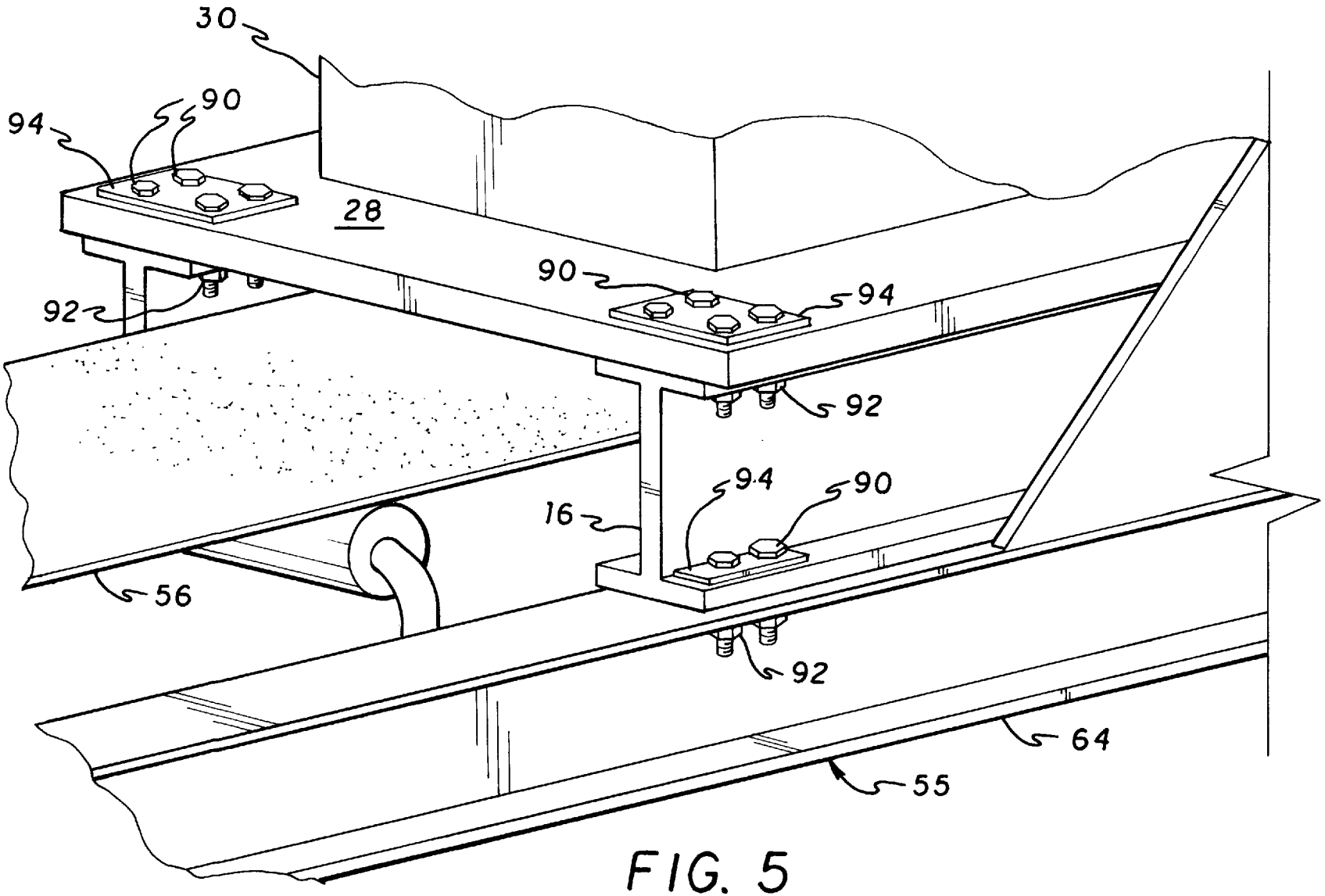
FIG. 5 is an enlarged scale perspective view which illustrates how the crusher and discharge conveyor are connected to the chassis of the drive unit.

Larger materials that enter crusher 30 through its receiving opening will be crushed by the reciprocating motion of jaw 32' relative to jaw 32, and the crushed material will fall from a lower end 49 of the crusher 30 onto a discharge conveyor 55. Discharge conveyor 55 has a frame 64 that releasably is secured to the vehicular frame 16, as shown in FIG. 5. Additional support for an outer end 59 of discharge conveyor 55 is provided by a pair of support cables 54 that extend between the vehicular frame 16 and the outer end 59. Discharge conveyor 55 is appropriately positioned with its receiving end 58 beneath crusher 30 to receive the crushed material and transport the same away from the rock crushing machine 10. Likewise, smaller materials that fall through the grate 45 of grizzly separator 44 enter the by-pass chute 50, which has its upper end aligned with the grate of the grizzly separator 44. By-pass chute 50 preferably conducts smaller material to the receiving end 58 of discharge conveyor 55. However, the discharge conveyor 55 may alternatively be positioned to allow the smaller material to fall directly from the by-pass chute 50 to the ground. It should be apparent that the entire discharge conveyor 55 may also be removed to allow the fines and dry crush to fall directly onto the ground in a windrow.

Figure 4:
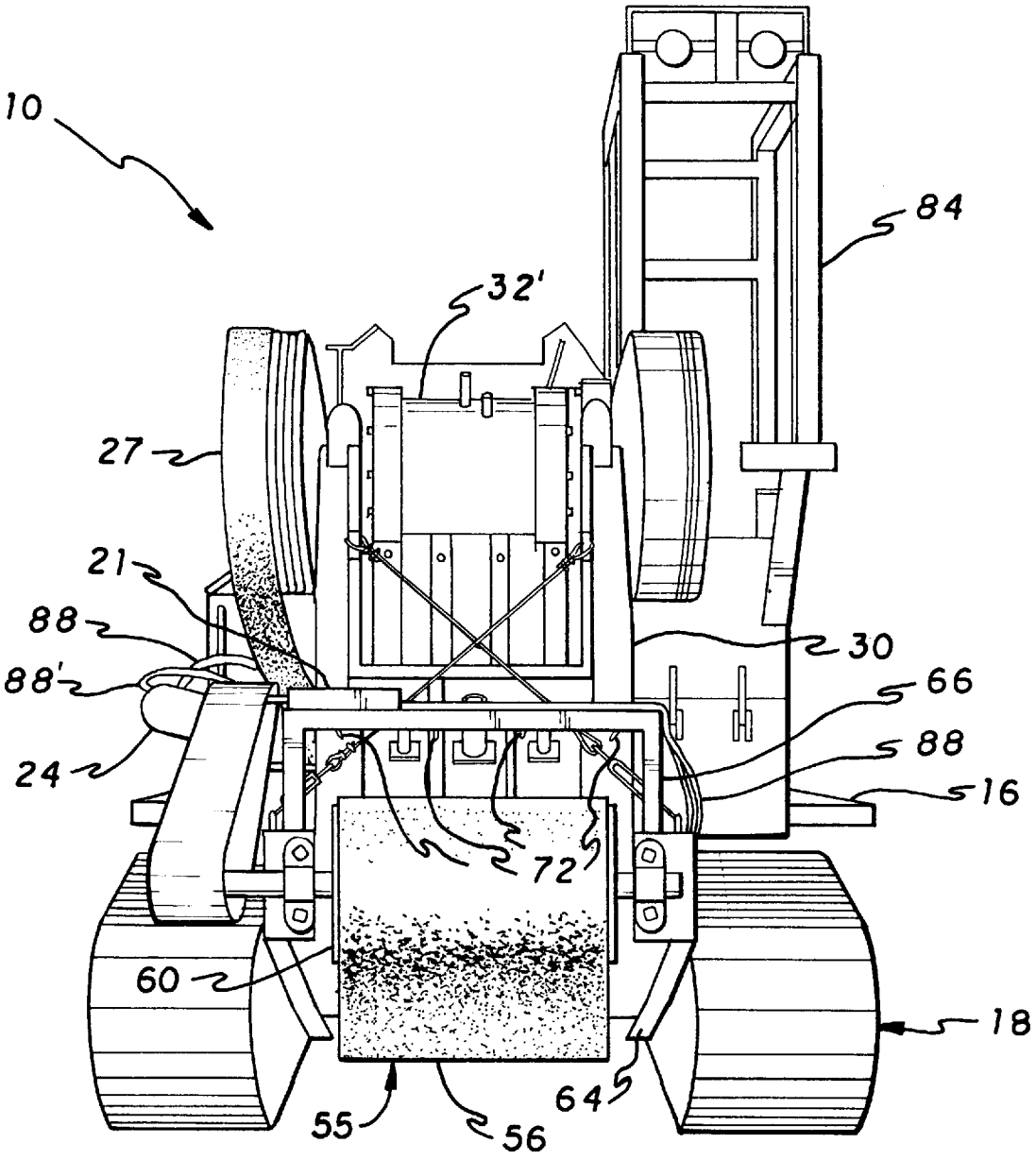
FIG. 4 is a front end view of the present invention.

The discharge conveyor 55 comprises a continuous belt 56 suspended about a driving roller 60 and a driven roller 62. A hydraulic motor 21 is releasably secured to a support bracket 66 that is mounted on the discharge end 59 of conveyor 55, as shown in FIG. 4. Hydraulic motor 21 is connected via a chain driven assembly to the driving roller 60, and thereby provides variable speed control for operation of conveyor 55. As hydraulic motor 21 drives roller 60, the belt 56 on conveyor 55 carries the material away from the crusher 30 and by-pass chute 50 for discharge onto the ground.

Releasably secured beneath the vehicular frame 16 is a water tank 68 that provides a supply of water for wetting the crushed material before it is discharged for later use. Preferably the water tank 68 has a capacity of 500 gallons. The water tank 68 is equipped with a hydraulic pump 69 connected to an output hose 70 that extends beneath the vehicular frame 16 and along the side of conveyor frame 64. The end of hose 70 is secured to the bracket 66 on the discharge end 59 of conveyor 55. As shown in FIG. 4, a plurality of nozzles 72 provided at the end of hose 70 are directed toward belt 56 to present a forced spray of water sufficient for wetting the crushed material. Hydraulic control over pump 69 provides the mechanism for controlling the flow of water through hose 70, as discussed hereinafter. In addition, a water truck may be employed with the crusher to provide a continuous source of water for tank 68. By travelling alongside the rock crushing machine 10, a water truck may continually replenish the supply of water in tank 68. A water tank 68 having sufficient capacity, i.e., 500 gallons, provides an ample resource of water during an interim period where a water truck leaves the construction site to refill its stores. By providing rock crushing machine 10 with its own water tank 68, the machine may discharge crushed material that already is saturated with water. Water saturated crushed material is preferable to dry crush during backfilling operations, because saturated backfill material will be less likely to sink and any sinking which does occur will be minimized. When conducting later backfilling operations, the operator may bring the backfill material closer to finish grade because it already has a sufficient moisture content. This obviates the need for extensive moving of fill or other material at a later time.

Referring specifically now to FIG. 5, the method for attaching crusher 30 and discharge conveyor 55 to the vehicular frame 16 is shown. Crusher 30 has its base 29 positioned on the vehicular frame 16 and is releasably secured to the same using a plurality of heavy duty bolts 90, nuts 92, and mounting plates 94. Each mounting plate 94 has a plurality of spaced holes (not shown), each of which is disposed to receive a single bolt 90. The holes in the mounting plates 94 are co-aligned with spaced holes (not shown) on the base 29 of the crusher and the vehicular frame 16. With the holes on the base of the crusher and the vehicular frame aligned, bolts 90 are inserted therethrough and releasably secured by tightening nuts 92 on the threaded end of the bolts 90. Because a number of plates 94 with nuts 92 and bolts 90 are used to releasably secure each of the components on the vehicular frame 16, it will be necessary to first align the components (i.e., align all of the holes on each component with the corresponding holes on the vehicular frame) before tightening the nuts and bolts. The same type of connection is used between the conveyor frame 64 and the vehicular frame 16, also shown in FIG. 5. Although not shown, the above described method for releasably securing the discharge conveyor 55 and crusher 30 to the vehicular frame 16 is also used for releasably securing the apron frame 39 to the top of the drive unit 12. The same type of bolt connection is used to secure the apron 36, hopper 34, and grizzly separator 44 to the apron frame 39. In addition, each of the hydraulic motors 21, 22, 23, 24 and pump 69 are bolted to an appropriate position on the vehicular frame 16, or elsewhere on the drive unit 12, using the same means of connection.

Referring specifically now to FIG. 3, the operator's station generally is denoted by the numeral 80. The operator's station 80 provides the operator with a number of controls 82 necessary to govern operation of the individual components. Each hydraulic motor 21, 22, 23, 24 and the hydraulic pump 69 has a pair of hydraulic fluid hoses 88, 88' (not all sets are shown) that are plumbed into the hydraulic system 20 of the drive unit 12 using quick release couplings. Control over the hydraulic motors and pump, and thus the components, is provided by the sets of controls 82 at the operator's station 80. For example, one set of controls 82 governs operation of the crawler type driving mechanism 18. Another set of controls 82 effects the speed at which the apron feeder 36 charges the crusher 30, the rate of crushing by the jaws 32, 32' of the crusher, and the speed of discharge conveyor 55, while yet another set of controls 82 governs operation of the water pump 69. An electrical switch (not shown) governs operation of the vibrator arm 46 by effecting the flow of hydraulic fluid to the hydraulic motor 23. Because a different hydraulic motor 21, 22, 23, and 24 operates a different component, each component is provided with variable speed control. Furthermore, because each component is provided with a separate hydraulic motor, operation of an individual component is independent of the other components.

To provide some degree of protection and comfort to the operator, the operator's station 80 is provided with a roll cage 84 (to protect the operator during operation of the rock crushing machine 10) and a chair 86. The roll cage 84 is releasably secured to the floor of the operator's station 80 using similar means shown at FIG. 5. This enables the overall height of the vehicle to be adjusted during transportation, as described hereinafter. While chair 86 may be fixed to the vehicular frame 16, it is preferable to provide a chair 86 capable of rotation because the rock crushing machine 10 preferably travels backwards during the crushing operation. A swivel base for chair 86 allows the operator to watch both the quantity of crush material discharged from conveyor 55, as well as the direction in which the rock crushing machine 10 travels.

In use, the rock crushing machine 10 initially will be maneuvered to the position where the crushed material is to be discharged. Before beginning the operation, a front end loader 75 or other similar type of construction equipment will provide the rock crushing machine 10 with a supply of material to be crushed, which is dumped into the hopper 34 as shown in FIG. 1. With the hopper 34 filled to capacity, the crushing operation may begin. To avoid backup or overflow at the crusher 30, the operator should start operation of the individual components beginning with the discharge conveyor 55, then the crusher 30, and finally the apron feeder 36. With the components all functioning, rock material will be carried forward from hopper 34 by the apron feeder 36. Rock material is then deposited onto the grizzly separator 44 where the smaller material is separated and falls into the by-pass chute 50. Larger rock material passes over the grizzly separator 44 and enters the receiving opening of the crusher 30. Larger rock material will be crushed by the jaws 32, 32' of the crusher 30 and eventually discharged from the lower end 49 of crusher 30. Fine and crushed material that falls from by-pass chute 50 and crusher 30, respectively, is deposited onto the receiving end 58 of conveyor 55. The fine and crushed material is then transported to the discharge end 59, where the fine and crushed material may be saturated with water forced from spray nozzle 72. Eventually the crushed and fine material falls from the discharge end 59 of conveyor 55, where it may accumulate in a pile or windrow.

Discharged material will be deposited into a pile if the rock crushing machine 10 is stationary during the crushing process. However, if the rock crushing machine 10 is driven on its crawler type drive mechanism 18 during the crushing process, then discharged material will be deposited into a windrow. The rock crushing machine 10 moves in reverse while crushing rock so that the crushed matter will be discharged from the conveyor 55 at the front end. In this way, the operator may assess the volume of discharged material as the rock crushing machine 10 drives away from the windrow rather than driving over it.

If the volume of discharged material appears to be excessive or deficient for the known purpose of such discharge material, the operator may selectively adjust the speed of each of the components using the controls 82. For instance, if the volume of discharge is insufficient, then the operator may effect a control 82 to increase the crushing capacity of crusher 30, and accordingly adjust the speed of apron feeder 36 and discharge conveyor 55 to accommodate the increased volume of crushed material. Alternatively, the operator may adjust the velocity of the rock crushing machine 10 to control the volume of crushed material left in the windrow.

The rock crushing machine 10 is particularly well suited for conducting operations along a trench line. An excavator or other digging device may remove earth while digging the trench, and dump the same directly into the hopper 34. The rock crushing machine 10 can operate in conjunction with the excavator to provide moisturized and properly sized backfill at the time of digging and at the place where it later will be needed. By crushing alongside the trench, for example, the activity performed in the trench (i.e., laying pipe) may occur behind the rock crushing machine 10 so that the moisturized and crushed material may be backfilled soon after being crushed. It should be apparent that great time savings are provided by limiting the number of times the material is handled.

In the event one of the components requires repair or possibly replacement, the individual component may be removed from the rock crushing machine 10 to effect such repairs or replacement. For example, if the discharge conveyor 55 needs to be replaced, then the discharge conveyor simply needs to be removed and a similar conveyor removably secured to the vehicular frame 16. To accomplish the replacement, each of the places where the conveyor frame 64 is joined to the vehicular frame 16 should be located. Next, the nuts 92 should be loosened from the bolts 90 for each mounting plate 94. Before separating the conveyor frame 64 from the vehicular frame 16, the cables 54 which support conveyor frame 64 must be loosened. Once the conveyor frame 64 is free from vehicular frame 16, the entire discharge conveyor 55 may be removed from the rock crushing machine 10. To assist in the removal of the component, a heavy duty engine winch may be used to support the weight of the component while it is attached or removed from the frame. It should be noted that the same process may be utilized for removal of all components if the owner wishes to convert the rock crushing machine 10 back into an excavator or other piece of heavy machinery from which the drive unit 12 originally was obtained.

The rock crushing machine 10 of the present invention may be prepared for highway transportation by a single person in about thirty (30) minutes. To prepare the rock crushing machine for transportation, it will be necessary to first remove the roll cage 84 from the operator's station 80. This is effected by loosening nuts 92 and bolts 90 as similarly described above for the crusher base 29 and conveyor frame 69. With the roll cage 84 removed, the rock crushing machine may be loaded onto a flatbed truck having a two foot ground clearance. The rock crushing machine 10 may be secured in place using a number of chains with come-along fasteners. The roll cage may be similarly secured to the flatbed for transportation. It is also preferable to further secure the discharge end 59 of conveyor 55 by providing support from beneath. When loaded and secured onto a flatbed for transportation, the rock crushing machine will safely fit beneath an overpass with a fifteen (15') foot clearance. This enables the flatbed trailer to transport the rock crushing machine over most major roads and highways without the need for a special permit.

It also should be noted that the rock crushing machine 10 is not limited for use solely as crushing rock removed directly from the earth. The rock crushing machine 10 is equally well suited for conducting crushing operations at a demolition site where a significant amount of concrete rubble is produced. The concrete rubble (including slabs up 24" by 36") may be reduced in the crusher 30, with the resulting concrete fines recycled for later use and the steel recycled either for later use or as scrap metal.

It is to be understood that the present invention is not limited to the sole embodiment described above, but encompasses any and all embodiments within the scope of the following claims.

I claim:

1. A self-propelled rock crushing machine, comprising:

a vehicular frame having a crawler type traveling device;

a drive unit mounted on said vehicular frame, said drive unit providing power to said crawler type traveling device;

a hopper disposed for storing the material to be crushed;

a crushing device having at least one crushing element operable to crush the material;

a first motor connected to said crushing device for imparting motion to said at least one crushing element to effect the crushing of the material;

charging means for transporting the material from said hopper to said crushing device;

discharge means for receiving the crushed material from said crushing device and transporting the crushed material away from said crushing device; and wherein said crawler type traveling device comprises a pair of left and right drive mechanisms, and said discharge means is located between said left and right drive mechanisms and immediately beneath said crushing device so that the discharge means has a ground clearance of at least seventeen inches to facilitate movement of the rock crushing machine while said crusher is operating.

2. The self-propelled rock crushing machine according to claim 1, wherein said hopper has a plurality of sidewalls, the lower ends of said sidewalls defining a lower opening, and said charging means comprises:

a first conveyor disposed for operation below said lower opening, said first conveyor having a continuous conveying surface suspended around a first driven roller and a first driving roller;

a charging motor connected to said first driving roller for imparting rotation to said driving roller to effect revolution of said conveying surface on said first conveyor; and charging control means for selectively regulating operation of said charging motor.

3. The self-propelled rock crushing machine according to claim 2, wherein said drive unit further includes a hydraulic fluid source and said charging motor is hydraulically coupled to said hydraulic fluid source, said charging control means comprise a manually operable valve for regulating the flow of hydraulic fluid to said charging motor.

4. The self-propelled rock crushing machine according to claim 1, further comprises:

separating means located intermediate said charging means and said crushing device for removing small materials from the materials charged to said crushing device.

5. The self-propelled rock crushing machine according to claim 4, said separating means comprising:

a grizzly separator angularly positioned with respect to said crusher, said grizzly separator having a grate with a plurality of openings for passage of the small materials;

vibrating means connected to said grizzly separator to agitate the materials passing over said grate; and a by-pass chute having an upper end aligned with said grate on said grizzly separator for receiving the small materials, and a lower end that extends below said vehicular frame.

6. The self-propelled rock crushing machine according to claim 5, wherein said vibrating means comprise:

a vibrating member connected to said grizzly separator; and a vibrator motor connected to said vibrating member to impart motion to said member for effecting agitation of said grizzly separator; and vibrating control means for regulating operation of said vibrating means.

7. The self-propelled rock crushing machine according to claim 6, wherein said drive unit further includes a hydraulic fluid source and said vibrator motor is hydraulically coupled to said hydraulic fluid source, said vibrating control means comprise a manually operable valve for regulating the flow of hydraulic fluid to said vibrator motor.

8. The self-propelled rock crushing machine according to claim 5, wherein said discharge means is positioned beneath said lower end of said by-pass chute to receive the small materials.

9. The self-propelled rock crushing machine according to claim 1, further comprising wetting means for saturating the crushed material before it is discharged.

10. The self-propelled rock crushing machine according to claim 9, wherein said wetting means comprises:

a liquid storage tank supported on said vehicular frame;

an outlet positioned above said discharge means for releasing the liquid onto the crushed material before the crushed material is discharged; and a pump communicating with said storage tank and said outlet, said pump transporting the liquid from said storage tank to said outlet; and pump control means for selectively regulating operation of said pump.

11. The self-propelled rock crushing machine according to claim 10, wherein said drive unit further includes a hydraulic fluid source and said pump is hydraulically coupled to said hydraulic fluid source, said pumping control means comprises a manually operable valve for regulating the flow of hydraulic fluid to said pump.

12. The self-propelled rock crushing machine according to claim 1, wherein said discharge means comprises:

a second conveyor disposed for operation below said crushing device, said second conveyor having a continuous conveying surface suspended around a second driven roller and a second driving roller;

a discharge motor connected to said second driving roller for imparting rotation to said second driving roller to effect revolution of said conveying surface on said second conveyor; and discharge control means for selectively regulating operation of said discharge motor.

13. The self-propelled rock crushing machine according to claim 12, wherein said drive unit further includes a hydraulic fluid source and said discharge motor is hydraulically coupled to said hydraulic fluid source, said discharge control means comprise a manually operable valve for regulating the flow of hydraulic fluid to said discharge motor.

* * * * *